US008757463B2

(12) United States Patent
Sagan

(10) Patent No.: US 8,757,463 B2
(45) Date of Patent: Jun. 24, 2014

(54) RUNNING BAG WITH A CONVEX BACK PANEL

(75) Inventor: Dave Sagan, Beaverton, OR (US)

(73) Assignee: Nike, Inc., Beaverton, OR (US)

( * ) Notice: Subject to any disclaimer, the term of this patent is extended or adjusted under 35 U.S.C. 154(b) by 127 days.

(21) Appl. No.: 12/789,958

(22) Filed: May 28, 2010

(65) Prior Publication Data

US 2011/0290843 A1 Dec. 1, 2011

(51) Int. Cl.
*A45F 3/08* (2006.01)

(52) U.S. Cl.
USPC ..... 224/644; 224/637; 224/642; 224/627

(58) Field of Classification Search
USPC ..... 224/637, 642, 645, 101, 191, 600, 627, 224/628, 630, 644, 231, 264, 640
See application file for complete search history.

(56) References Cited

U.S. PATENT DOCUMENTS

| | | | | |
|---|---|---|---|---|
| 4,842,173 | A * | 6/1989 | Scherer | 224/631 |
| 5,004,135 | A * | 4/1991 | Dufournet et al. | 224/632 |
| 5,320,262 | A * | 6/1994 | Levis | 224/630 |
| 5,419,473 | A * | 5/1995 | Lamar | 224/632 |
| 5,762,243 | A * | 6/1998 | McMaster et al. | 224/262 |
| 5,954,253 | A * | 9/1999 | Swetish | 224/631 |
| D507,697 | S * | 7/2005 | Seong | D3/216 |
| 7,337,935 | B1 * | 3/2008 | Glanville | 224/628 |
| 2002/0158097 | A1 * | 10/2002 | Beale | 224/644 |
| 2003/0034372 | A1 * | 2/2003 | Thompson et al. | 224/637 |

FOREIGN PATENT DOCUMENTS

| | | |
|---|---|---|
| WO | 2009021245 | 2/2009 |
| WO | WO 2009021245 A2 * | 2/2009 |

OTHER PUBLICATIONS

The International Search Report and The Written Opinion for PCT/US11/38411; filed May 27, 2011.

* cited by examiner

*Primary Examiner* — Nathan J Newhouse
*Assistant Examiner* — Corey Skurdal
(74) *Attorney, Agent, or Firm* — Shook, Hardy & Bacon L.L.P.

(57) ABSTRACT

Systems and methods for carrying a load on the back of a user and backpacks having a convex back panel are described. The convex back panel of the backpack may curve outward from the center of a wearer's back to minimize contact between the backpack and the wearer's back The backpack may also have a center-support panel for contacting the spinal region of the back of the wearer of the backpack. The center-support panel may have grooves for distributing a load along a wearer's back.

11 Claims, 5 Drawing Sheets

RUNNING BAG WITH A CONVEX BACK PANEL

SUMMARY

Embodiments of the invention are defined by the claims below, not this summary. A high-level overview of various aspects of the invention are provided here for that reason, to provide an overview of the disclosure, and to introduce a selection of concepts that are further described below in the detailed-description section below. This summary is not intended to identify key features or essential features of the claimed subject matter, nor is it intended to be used as an aid in isolation to determine the scope of the claimed subject matter.

For commuters who utilize backpacks in their daily commute, compromises are often made between size, weight, comfort and stability. Generally, small, frame free, backpacks, while more lightweight and less cumbersome for commuters often accommodate only the bare essentials and can lead to carrying multiple bags for the unseasoned commuter. Lightweight backpacks are typically comprised of mesh materials that offer very little insulation and protection to the contents of the backpack. Lightweight conventional packs also generally conform to the shape of the contents placed therein, allowing objects contained in the pack to protrude from the pack and irritate the back of the user.

Traditional backpacks that can carry more items generally resemble hiking bags and are often heavy, bulky and difficult to maneuver. Conventional backpacks typically lay flat across the back of the wearer and block air flow to the user's back. With no way for the sweat from the user's back to evaporate, conventional packs often result in the user's clothing, the backpack and even the contents thereof, absorbing the user's sweat. Moreover, during activities such as running, where the wearer of the bag is moving, traditional backpacks are generally unstable and allow the backpack and its contents to bounce around and irritate the back of the wearer. As such, there is a need for a lightweight, breathable backpack that has minimal contact with the wearer's back that is also stable when the wearer is in motion.

Embodiments of the present invention provide systems and methods for carrying a load on the back of a user utilizing a backpack having a convex back panel. In various embodiments, the backpack may have a center-support panel that contacts the thoracic and lumbar spine regions of a wearer's back. In these embodiments, the center-support panel may include a set of grooves that contact the wearer's spine and distributes the load along the wearer's back. In various embodiments, the center-support panel may also include a set of air channels that enable air flow between the center-support panel and the wearer's back.

BRIEF DESCRIPTION OF THE SEVERAL VIEWS OF THE DRAWINGS

Illustrative embodiments of the present invention are described in detail below with reference to the attached drawing figures, which are incorporated by reference herein and wherein.

DETAILED DESCRIPTION

Figure 1:
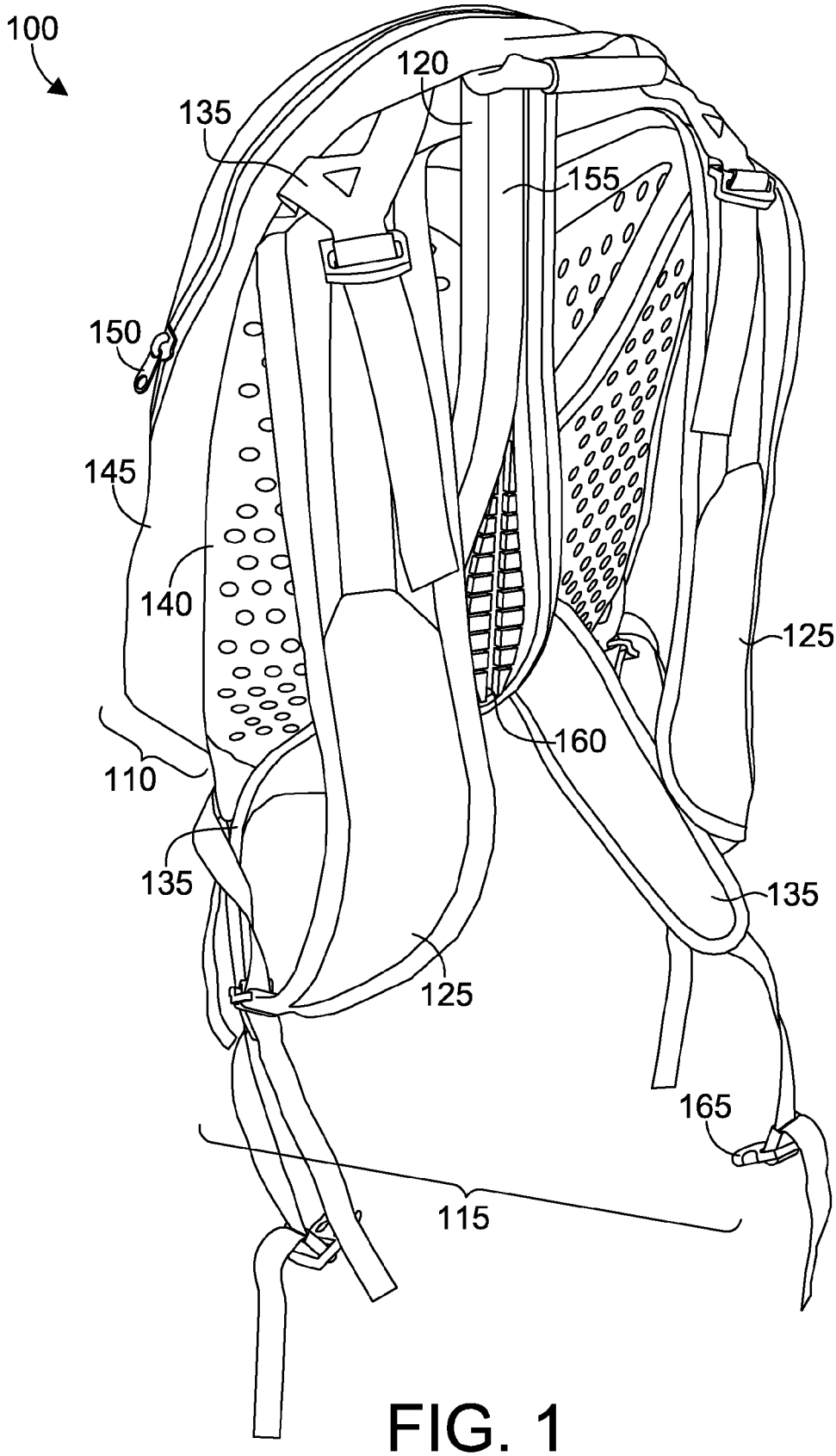
FIG. 1 depicts a perspective view of a backpack embodying features of the present invention.

The subject matter of the present invention is described with specificity herein to meet statutory requirements. However, the description itself is not intended to necessarily limit the scope of claims. Rather, the claimed subject matter might be embodied in other ways to include different steps or combinations of steps similar to the ones described in this document, in conjunction with other present or future technologies. Although the terms "step" and/or "block" or "module" etc. might be used herein to connote different components of methods or systems employed, the terms should not be interpreted as implying any particular order among or between various steps herein disclosed unless and except when the order of individual steps is explicitly described.

The present invention relates to a backpack having a bag with convex back panel. When the backpack is worn by a user, the convex back panel may curve outward from the center of a user's back along a radial axis such that the bag has minimal contact with the user's back. A pair of shoulder straps operably connected to the convex back panel to secure the backpack to the back of a user when the backpack is worn. A backpack in accordance with the present invention may further have a center-support panel that contacts the thoracic and lumbar spinal region of a wearer's back. The pair of shoulder straps may be affixed to the support panel to operably connect the straps to the convex back panel. The invention further relates to method for carrying a load on the back of a user utilizing a backpack having a convex back panel and, optionally, a center-support panel. A backpack in accordance with the present invention may have a center-support panel having grooves for distributing a load along the user's back. The center-support panel may also include a set of air-channels that facilitate air flow between the center-support panel and the wearer's back.

Accordingly, in one aspect, the present invention provides a backpack. The backpack may include a harness attached to at least one back panel of a backpack body. The harness may include a center-support panel that contacts at least a portion of each of a wearer's thoracic spinal region and lumbar spinal region when the backpack is worn. The harness may also include a pair of adjustable shoulder straps affixed to the center-support panel. The backpack may further include the backpack body having at least one back panel curving outward from a center of a wearer's back along a radial axis such that backpack body has minimal contact with the wearer's back. The center-support panel may further include a plurality of grooves that contact a wearer's spine and a plurality of air channels. The plurality of grooves distributes a load along a wearer's back while the plurality of air channels provide ventilation by facilitating air flow between the center-support panel and the wearer's back.

In another aspect, the present invention provides a system for carrying a load on the back of a user in motion. The system includes a bag having a convex back panel curving outward from a center of the user's back along a radial axis such that the bag has minimal contact with the user's back when the bag is worn. The system may also include a pair of shoulder straps connected to the convex back panel to secure the bag to the back of a user when the bag is worn. The system may further include a support panel attached to a middle of the convex back panel of the bag, the support panel having a shape to conform to the natural curve of the user's spine when the bag is worn. The system may further include a pair of adjustable waist-belts affixed to the support panel along a portion of the support panel conforming to the user's lumbar spine. The system may even further include a plurality of adjustable stability straps attached to a top edge of the convex back panel and to each of the shoulder straps.

In yet another aspect, the present invention provides a method for carrying a load on the back of a user utilizing a curved running bag. The method includes providing a bag, the bag including a harness, where the harness may include a center-support panel for contacting at least a portion of each of a user's thoracic spinal region and lumbar spinal region. The center-support panel may have a plurality of grooves that contact a user's spine and a plurality of air channels, where the plurality of grooves distributes a load along a user's back and where the plurality of air channels, provide ventilation by facilitating air flow between the center-support panel and the wearer's back. The bag may further include a pair of adjustable shoulder straps affixed to the center-support panel and a pair of adjustable waist-belt straps affixed to the center-support panel. The bag may also include a backpack body having at least one back panel curving outward from a center of the user's back along a radial axis such that the backpack body has minimal contact with the user's back. The harness may be attached to the at least one back panel of the backpack body. The method also includes inserting the load in the bag and wearing the bag during a motion intensive activity.

Embodiments of the present invention provide systems and methods for carrying a load on the back of a user and backpacks having a convex back panel. Having briefly described an overview of embodiments of the present invention, an exemplary backpack having a convex back panel and center-support panel is described below.

Referring to the drawings in general and FIGS. 1-6 in particular, an exemplary backpack having a convex back panel and center-support panel is depicted in various views. While embodiments discussed herein refer to bags including a backpack, it will be understood that embodiments are not limited to any particular style or type of bag carried on the shoulders and back area of the wearer. For example, other embodiments may include frame packs, or packs having a hip belt and the like with a convex back panel and, optionally, center-support panel. Further, the depictions in the drawings are for exemplary purposes only and are in no way meant to limit the scope of the present invention to any type of activity involving carrying a load.

Referring now to FIG. 1, a perspective view of an example backpack embodying features of the present invention is illustrated and designated generally as reference numeral 100. Backpack 100, includes a backpack body 110, harness assembly 115, center-support panel 120, shoulder straps 125, waist-belt straps 130, and stability straps 135. Backpack body 110 includes back panel 140 and side wall 145, which may be assembled to form one or more compartments that may be secured by a zipper closure 150. In embodiments, the back panel 140 may be constructed to curve outward from a center of a wearer's back. Back panel 140 may be constructed from a lightweight, compressible foam material. The material of back panel 140 should be sufficiently rigid to enable the backpack body 110 to maintain a convex shape when items are placed in backpack 100. The material of back panel 140 should also provide sufficient structure to the backpack 100 to prevent items placed in backpack 100 from protruding through the bag and contacting the back of a wearer. However, the material of back panel 140 should be sufficiently pliable to allow the back panel to be manipulated into a convex shape during construction of the backpack. By way of example, the back panel 140 may be constructed from an ehtylene-vinyl acetate (EVA) foam or a similar foam material.

Backpack body may comprise a bag 110 that may be secured to harness 115 by any construction method used in bag manufacturing, such as stitching. Harness assembly 115 may include a pair of adjustable shoulder straps 125 which can be secured around the shoulders of the wearer. Shoulder straps 125 may be padded for comfort and may be shortened or lengthened based upon the height of the wearer. Shoulder straps 125 may be attached to and/or extend from the center-support panel 120 of harness assembly 115 to operably connect the shoulder straps 125 to bag 110. The center-support panel 120 may be attached to the back panel 140 of bag 110 and may extend from a top edge to a bottom edge of the center of the back panel 140. The shoulder straps 125 attached the center-support panel 120 allows the weight of the backpack 100 to be distributed across the shoulders and along the central portion of the back of the wearer. The convex shape of back panel 140 allows the back panel 140 to extend outward along a radial axis from center-support panel 120 such that backpack body 110 has minimal contact with the wearers back. The convex shape of back panel 140 provides more room on either side of the wearer's spinal region for evaporation of sweat from the wearer's back than convention backpacks.

Center-support panel 120 may include several grooves 155 that contact the spinal region of a wearer's back. The grooves 155 may be configured to contact a wearer's back in a fashion that sufficiently distributes the load of the backpack along the spinal region of the back of the wearer without causing skin abrasion. The center-support panel 120 may also contain several air channels 160 that provide airflow between the center-support panel 120 and the wearer's back. A pair of adjustable waist-belt straps 130 may be affixed to the center-support panel 120. Waist-belt straps 130 may be padded for the comfort of the wearer of backpack 100. The waist-belt straps 130 may also include fasteners 165, which can be secured around the hip or waist of the wearer.

Backpack 100, may include a pair of "A shaped" stability straps 135 attached to the top edge of back panel 140 on either side of center-support panel 120. The stability straps 135 may also be adjustably secured to the shoulder straps 125. The stability straps 135 may prevent the backpack body 110 from swinging back and forth across the wearer's back when the wearer is in motion. By way of example, during an outdoor activity such as running or biking, stability straps 135 may prevent the backpack body from alternately contacting the left and right scapula of the wearer of backpack 100.

Figure 2:
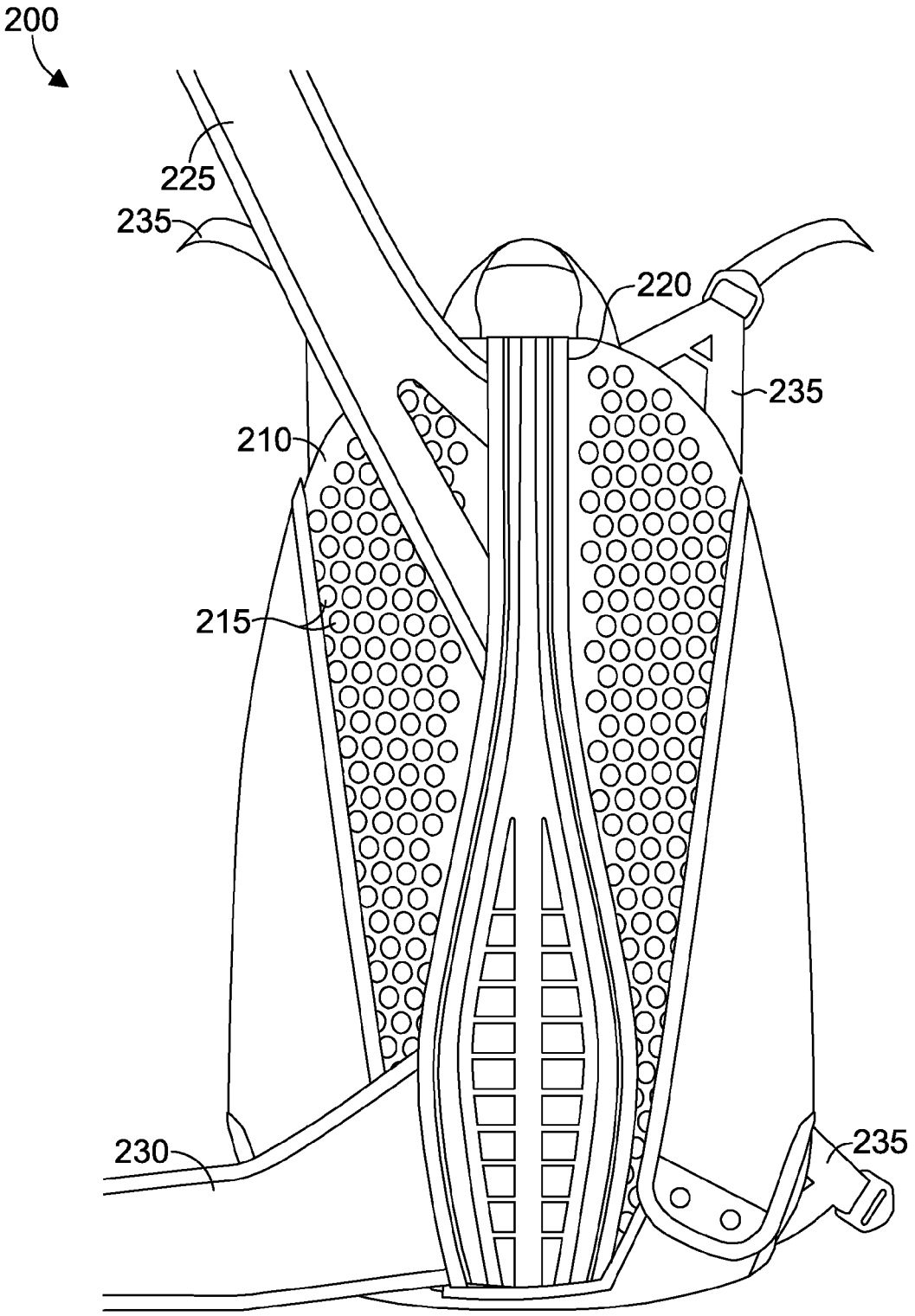
FIG. 2 depicts a rear view of a backpack embodying features of the present invention.

Turning now to FIG. 2, a rear view of an example backpack embodying features of the present invention is illustrated and designated generally as reference number 200. Backpack 200 includes back panel 210, perforations 215, center-support panel 220, shoulder strap 225, waist-belt straps 230, and stability straps 235. In embodiments, the back panel 210 may be constructed to curve outward from a center of a wearer's back. Back panel 210 may be constructed from a compressible foam material and may include several perforations 215 evenly spaced throughout back panel 210. Perforations 215 may be manufactured by dye cutting or any other process used to generate large numbers of the same shape in a compressible foam material. The perforations 215 may contribute to making backpack 200 lightweight.

The center-support panel 220 may be attached to the back panel 210 of backpack 200 and may extend from a top edge to a bottom edge of the center of the back panel 210. The center-support panel 220 may be constructed from a compressible molded foam material. By way of example, the center-support panel may be constructed from EVA molded foam. Secured to and extending from center-support panel may be shoulder strap 225. Shoulder strap 225 may be padded and adjustable. Shoulder strap 225 may be constructed of materials conventionally used in backpack manufacturing including but not limited to foam, nylon and canvas. In conventional backpacks the shoulder-straps are typically attached to the outer edges of the backpack body. This conventional placement generally ensures that the backpack body lies flush against the entire back of the wearer of the backpack, thereby eliminating airflow to the wearer's back. The conventional backpack can become uncomfortable when worn for an extended period of time as the reduced airflow to the back of the wearer may result in the wearer's clothing and even the contents of the backpack becoming drenched with sweat. Unlike the conventional backpack, the backpack 200 may feature a pair of shoulder straps 225 extending from either side of center-support panel 220. This placement of shoulder strap 225 eliminates the straps from forcing back panel 210 of the backpack against the entire back of the wearer, while operably connecting the shoulder straps 225 to the back panel 210 of backpack 200. Similarly, backpack 200 may also include waist belt strap 230 that attaches to and/or extends from either side of the lumbar portion the center-support panel 220. Waist belt strap 230 may be constructed from similar materials as shoulder strap 225. Backpack 200 may also include a pair of stability straps 235 secured to the top edge of back panel 210. The stability straps 235 may be adjustably secured to the shoulder straps 225 and may be constructed from a lightweight material having a high tensile strength. By way of example, stability straps 235 may be constructed from chlorosulfonated polyethylene synthetic rubber. Straps 235 may serve to anchor the backpack body to the center-support panel 220 and may stabilize the backpack 200 and prevent the backpack body from bouncing around the either side of the center-support panel 220.

Figure 3:
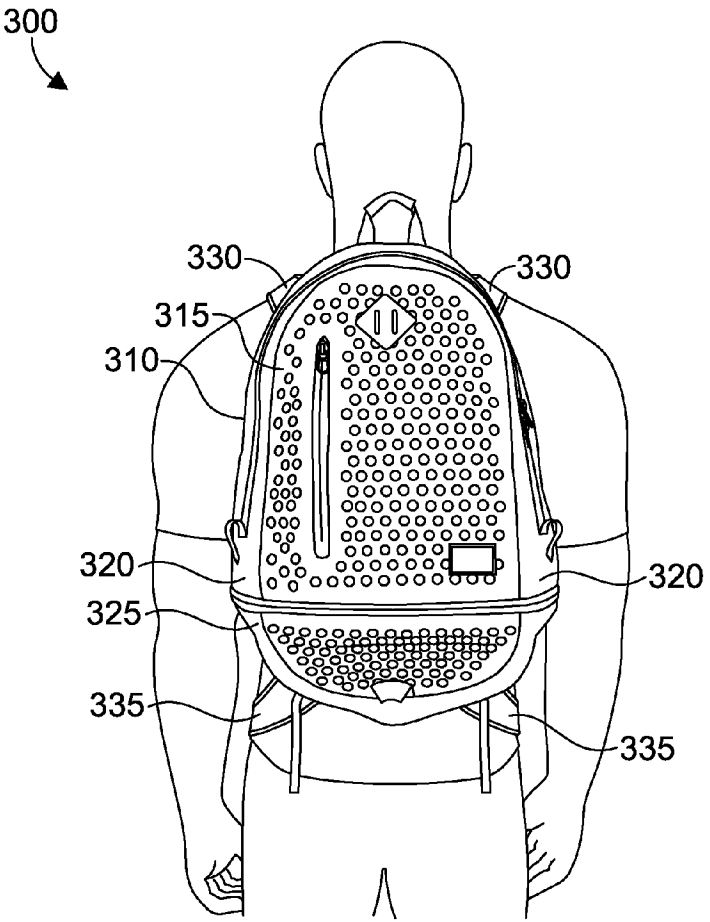
FIG. 3 depicts a front view of a backpack embodying features of the present invention.

Turning now to FIG. 3, a front view of an example backpack embodying features of the present invention being worn is illustrated and designated generally as reference number 300. Backpack 300 includes a backpack body 310, a front panel 315, side panels 320, a bottom panel 325, shoulder-straps 330 and waist belt straps 335. Backpack body 310 may include panels such as front panel 315, side panels 320, a bottom panel 325 defining one or more compartments in which a load may be placed. Front panel 315 may be constructed in a similar fashion as back panel 210, and may include a compressible foam material having several dye cut perforations. Front panel 315 may be constructed from a lightweight, compressible foam material such as EVA foam. Side panels 320, and bottom panel 325 may form the walls of backpack body 310 and may be constructed of a nylon material or similar known materials used in backpack manufacturing. Backpack 300 may include shoulder straps 330 that extend around a wearer's shoulders. Backpack 300 may also include waist belt straps 335 that may be secured around the hip or waist of the wearer.

Figure 4:
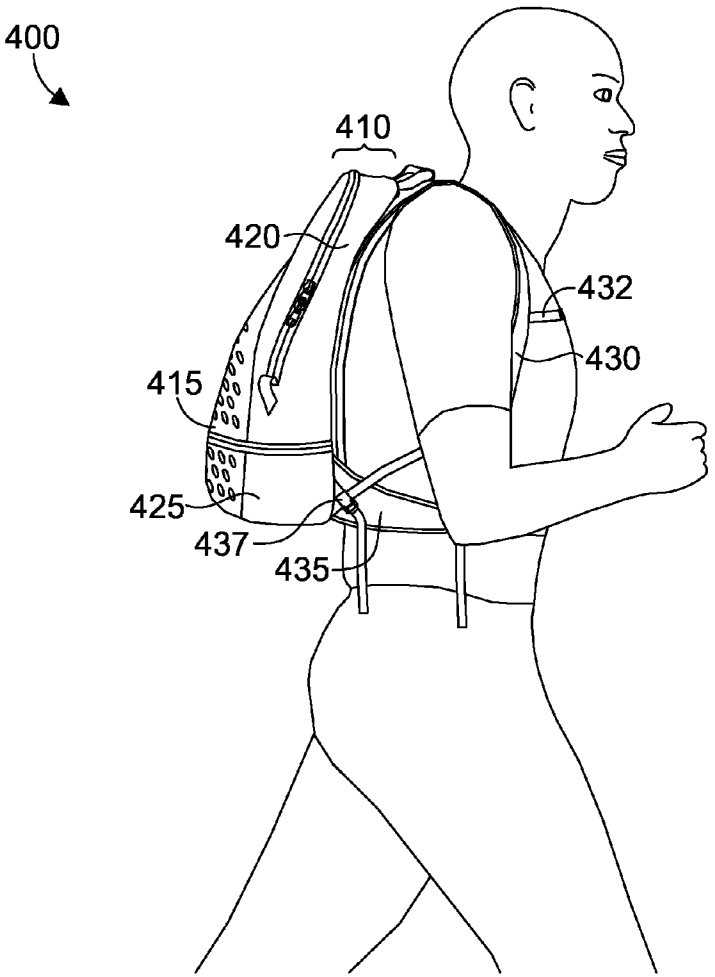
FIG. 4 depicts a side view of a backpack embodying features of the present invention.

Turning now to FIG. 4, a side view of an example backpack embodying features of the present invention being worn is illustrated and designated generally as reference number 400. Backpack 400 includes a backpack body 410, front panel 415, side wall 420, bottom wall 425, shoulder strap 430, sternum strap 432, and waist belt strap 435. Backpack body 410 includes a front panel 415, side walls 420 and bottom wall 425 configured to form one or more compartments of the backpack 400. The wearer 440 can user the compartments of backpack 400 to carry a load on the back of the wearer 440 in motion. Shoulder-strap 430 may extend around the shoulders and torso of wearer 440. Shoulder strap 430 may be padded and adjustable. In some embodiments shoulder strap may also include a sternum strap 432 attached to the shoulder strap. Sternum strap 432 may be adjustable and may be fastened in front of the torso of the wearer of back pack 400 to provide additional stability to backpack 400 while the wearer is involved in a high motion activity such as running. Backpack 400 may also include waist belt straps 435 that may be secured around the hip or waist of the wearer 440. Adjustable stability straps 437 may also be attached to bottom portion of the backpack body and to waist belt strap 435. The stability straps 437 may prevent bouncing of the backpack body 410 while wearer 440 is in motion.

Figure 5:
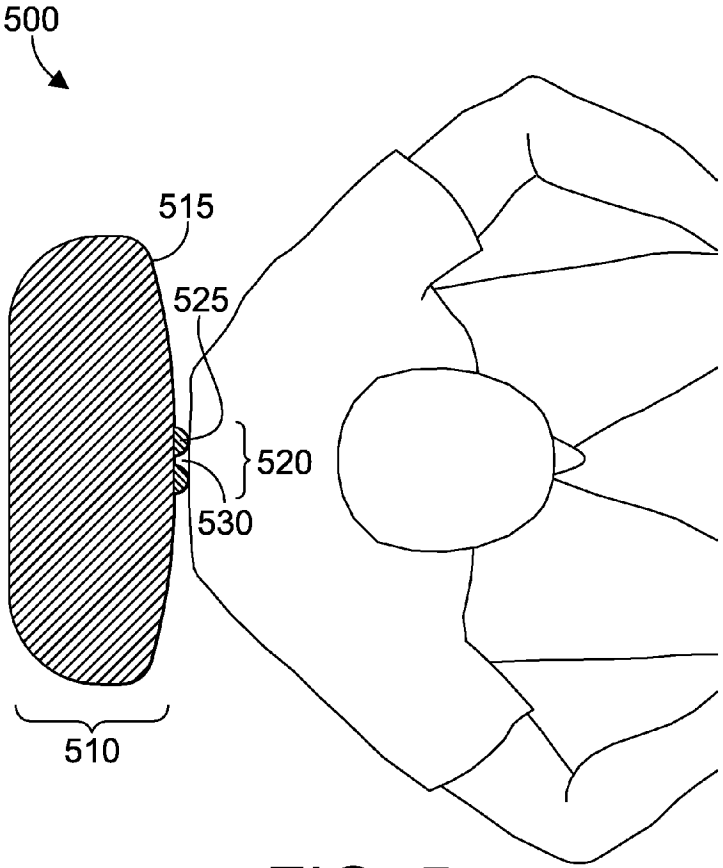
FIG. 5 depicts a top-view of a user wearing a backpack embodying features of the present invention.

Turning now to FIG. 5, a diagram of a top-view of a user wearing an example backpack embodying features of the present invention is illustrated and designated generally as reference number 500. The backpack body 510 may include a back panel 515, and center-support panel 520. The back panel 515 may be convex such the back panel 515 curves outward from the center of a wearer's back along a radial axis such that backpack body has minimal contact with the wearer's back. The back panel 515 may also curve away from the center-support panel 520. Center-support panel 520 may contact the spinal region of the wearer's back. The center-support panel may have grooves 525 that contact portions of a wearer's spinal region. The grooves 525 may distribute the weight of the backpack body along the central region of a wearer's back. The center-support panel may also include an air channel 530 that allows air to flow between the center-support panel and wearer's back.

Figures 6A, 6B:
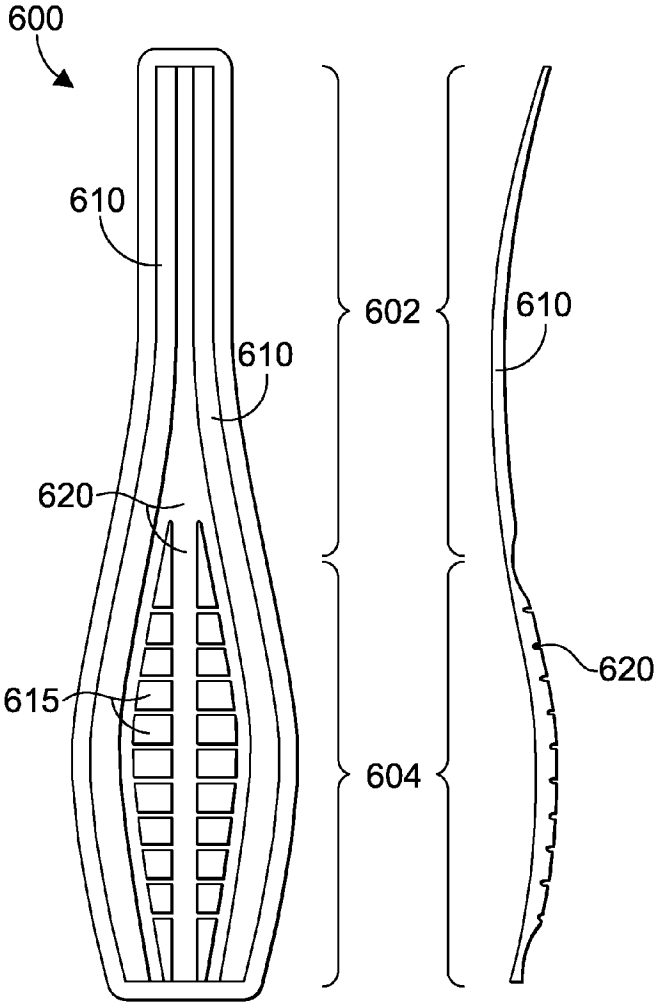
FIG. 6A depicts a front view of a center-support panel in accordance with an embodiment of the present invention.
FIG. 6B depicts a side view of a center-support panel in accordance with an embodiment of the present invention.

Turning now to FIG. 6, different views of a center-support panel in accordance with an embodiment of the present invention are illustrated and designated generally as reference number 600. FIG. 6A depicts a front view of center-support panel 600. FIG. 6B depicts a side view of center-support panel. Center-support panel 600 may be constructed from a compressible foam material. Center-support panel may also be manufactured utilizing compression molding techniques. The material used for center-support panel should be rigid enough to grant structure to the backpack yet compressible enough to conform to the wearer's back and prevent skin abrasion. Center-support panel 600 may include an upper region 602 and a lower region 604. Upper region 602 may include the portion of center-support panel 600 designed to contact mainly the thoracic spinal region of a wearer's back. In some embodiments, upper region 602 of the center-support panel may also contact portions of the lower cervical spinal region of a wearer. Lower region 604 includes the portion of center-support panel 600 designed to contact mainly the lumber spinal region of a wearer's back. Upper region 602 may be narrower than lower region 604 of the center-support panel 600. The narrowness of upper region 602 may allow the shoulder straps extending from the center support panel as shown in FIG. 2, to be close together. This configuration in contrast to traditional backpacks prevents the shoulder straps from pulling the backpack body against a broad surface of the wearer's back.

Center-support panel 600 may also include several grooves 610. The grooves 610 may extend from upper region 602 to lower region 604 of the center-support panel 600. Grooves 610 may contact the surface of the wearer's back, and may provide a contact surface between the backpack and the wearer's back to allow distribution of the load of the backpack along the wearer's back. Center-support panel 600 may include in the lower region 604 several contours 615. The contours 615 may provide additional contact surface with wearer's lower back where the weight of a backpack is generally concentrated. The contours 615 further distribute the weight of the backpack across portions of the wearer's back so as to prevent skin abrasion in the areas where the load is heaviest. Center-support panel 600 may also include air channel 620. The air channels 620 extend from the upper 602 to lower regions 604 of center-support panel 600, and run between the grooves 610 and contours 615 of the center-support panel 600. The air channels 610 enables air flow between the back of the wearer and center-support panel 600, thereby enabling evaporative and convective cooling of the wearer's back. By facilitating air flow between the center-support panel and the wearer's bag, the air channels reduce the likelihood of sweat saturating the wearer's clothing or the contents of the backpack.

Figure 7:
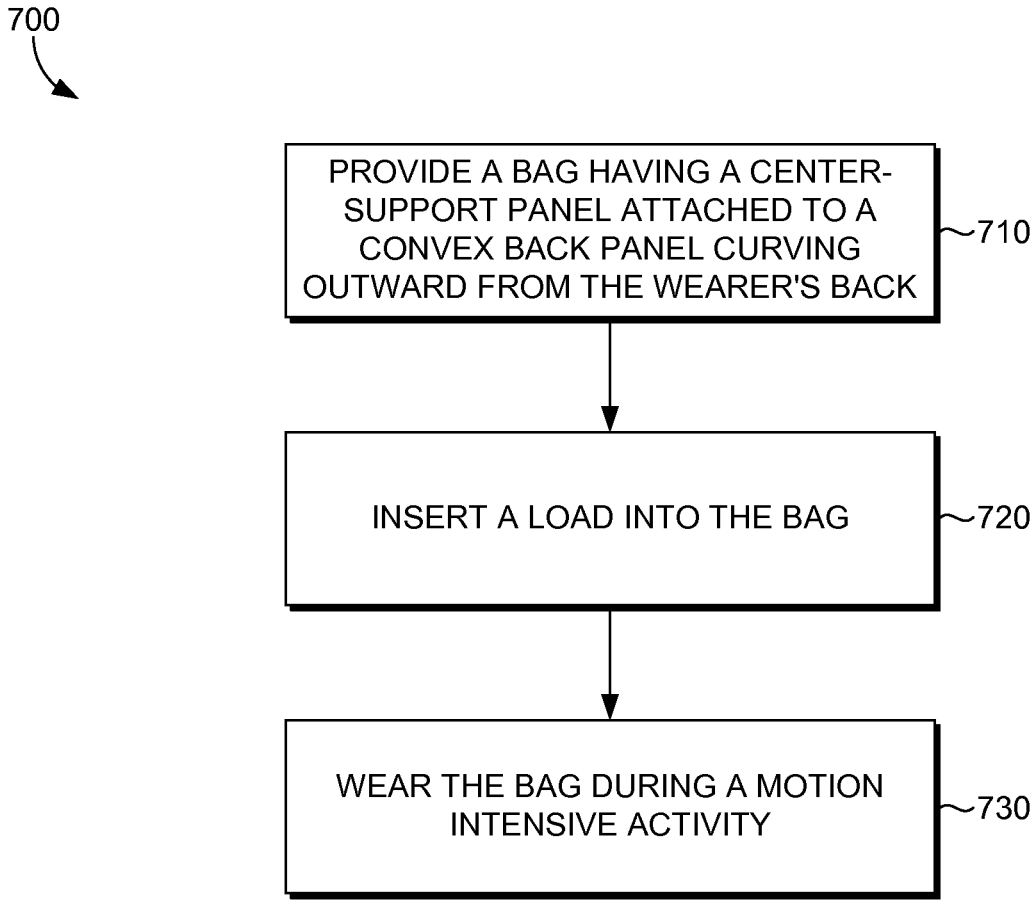
FIG. 7 depicts a block diagram of an overall method of carrying a load utilizing a backpack in accordance with an embodiment of the present invention.

Turning now to FIG. 7, a block diagram is provided that illustrates an example method 700 of carrying a load utilizing a backpack in accordance with an embodiment of the present invention. Initially, as shown at block 710, a bag for carrying a load on the back of a wearer may be provided. The bag may be a backpack having a convex back panel that contacts only a portion of the spinal region of the wearer's back. The backpack may further have a center support panel, a pair of adjustable shoulder straps and a pair of adjustable waist-belt straps affixed to the center-support panel. A load may be inserted into the bag, as shown at block 720. The backpack containing the load may be worn during a motion intensive activity, as shown at block 730.

Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

Embodiments of the present invention provide systems and methods for carrying a load on the back of a user in motion. The invention relates to a backpack having a convex back panel curving outward from the center of a wearer's back to minimize contact between the backpack and the wearer's back. The invention may further relate to a backpack having a center-support panel for contacting the spinal region of the back of the wearer. The center-support panel may have grooves for distributing a load along a wearer's back.

The invention claimed is:

1. A backpack comprising:

a bag having a convex back panel curving outward from a center of the user's back along a radial axis such that the bag has minimal contact with the user's back when the backpack is worn, wherein the convex back panel further comprises a continuous, single support panel extending through a height of the bag from a top side to a bottom side, the support panel having an elongated upper region that contacts at least a portion of a thoracic spinal region of the user's back when the backpack is worn and a lower region contacting at least a portion of a lumbar spinal region when the backpack is worn, the upper region of the support panel having a uniform width throughout its length and the upper region being narrower than the lower region;

the support panel comprising grooves extending from the upper region to the lower region and a plurality of contours in the lower region for providing a contact surface for contacting the user's back;

the support panel further comprising a plurality of connecting air channels extending from the upper region to the lower region, running between the grooves and the plurality of contours in the support panel; and a pair of adjustable shoulder straps operably connected to the convex back panel to secure the backpack to the back of a user when the backpack is worn.

2. The backpack of claim 1, wherein the support panel is attached to a middle of the convex back panel of the bag, the support panel having a shape to conform to the natural curve of the spine of the user when the bag is worn, such that the support panel contacts the center of the user's back when the backpack is worn.

3. The backpack of claim 2, wherein the convex back panel of the bag curves away from the support panel such that only the support panel comes in contact with the user's back when the backpack is worn.

4. The backpack of claim 3, wherein the pair of shoulder straps operably connect to the convex back panel at least in part by being affixed to the convex back panel at least in part by being affixed to the support panel.

5. The backpack of claim 4, wherein the support panel is constructed of a compression molded foam material.

6. The backpack of claim 4, wherein the pair of shoulder straps are affixed to the support panel along a portion of the support panel conforming to the user's upper thoracic spine when the backpack is worn.

7. The backpack of claim 6, further comprising:

a pair of adjustable waist-belts affixed to the support panel along a portion of the support panel conforming to the user's lumbar spine when the backpack is worn; and a plurality of adjustable stability straps attached to a top edge of the convex back panel and to each of the shoulder straps.

8. The backpack of claim 7, wherein the bag further comprises a front panel, a bottom wall, and side walls defining a plurality of compartments.

9. The backpack of claim 8, wherein the front panel and back panel further comprise a plurality of perforations.

10. The backpack of claim 9, wherein the front panel and back panel are constructed of a lightweight, compressible foam material.

11. The backpack of claim 10, further comprising a plurality of adjustable sternum straps attached to the pair of adjustable shoulder straps.

* * * * *